US005570567A

United States Patent [19]

Laubscher et al.

[11] Patent Number: 5,570,567

[45] Date of Patent: Nov. 5, 1996

[54] PACKING OF CYLINDRICAL ARTICLES

[75] Inventors: Stephen K. Laubscher; James M. O'Neill, both of Cape Town, South Africa

[73] Assignee: Metal Box South Africa Ltd., South Africa

[21] Appl. No.: 345,247

[22] Filed: Nov. 28, 1994

[30] Foreign Application Priority Data

Dec. 1, 1993 [ZA] South Africa ..... 93/8985

[51] Int. Cl.[6] ..... B65B 35/30

[52] U.S. Cl. ..... 53/443; 53/446; 53/447; 53/475; 53/495; 53/530; 53/535; 53/540; 53/544; 53/258; 198/418.5; 198/429; 414/791.5; 414/792.5; 414/794.7

[58] Field of Search ..... 414/792.5, 791.5, 414/794.7; 198/416, 418.5, 429, 430; 53/439, 446, 447, 448, 475, 495, 529, 530, 535, 540, 543, 544, 245, 247, 258, 443

[56] References Cited

U.S. PATENT DOCUMENTS

| | | | |
|---|---|---|---|
| 1,950,370 | 3/1934 | Mudd | 53/535 X |
| 2,633,280 | 3/1953 | Davies | 53/529 X |
| 3,682,290 | 8/1972 | Von Gal | 198/418.5 |
| 3,859,772 | 1/1975 | Thierion | 53/544 X |
| 3,979,878 | 9/1976 | Berney | 53/495 |
| 3,990,566 | 11/1976 | Nordqvist | 198/418.5 |
| 4,003,185 | 1/1977 | Goff | 53/543 X |
| 4,120,406 | 10/1978 | Durnig | 414/791.5 |
| 4,231,697 | 11/1980 | Franz | 414/794.7 X |
| 4,534,153 | 8/1985 | Nowicki . | |
| 4,929,140 | 5/1990 | Baker | 198/429 X |
| 4,942,720 | 7/1990 | Berney | 53/535 X |
| 5,074,103 | 12/1991 | McDowell | 53/495 |

FOREIGN PATENT DOCUMENTS

| | | | |
|---|---|---|---|
| 0325411 | 1/1989 | European Pat. Off. . | |
| 1231613 | 12/1963 | Germany . | |
| 3943025 | 12/1989 | Germany . | |
| 532227 | 2/1993 | Japan | 198/416 |

*Primary Examiner*—Daniel Moon
*Attorney, Agent, or Firm*—James Ray & Associates

[57] ABSTRACT

Equipment 10 for packing cylindrical articles includes a receiving station 18 for receiving articles to be packed. A displacing device is arranged in the receiving station 18 in proximity to a conveyor 16 for displacing articles from the conveyor 16. An accumulating station 22 is mountable relative to the conveyor 16 to receive articles displaced from the conveyor 16. The accumulating station 22 is displaceably arranged relative to the receiving station 18 to facilitate formation of a predetermined close packed array in the accumulating station 22.

17 Claims, 3 Drawing Sheets

PACKING OF CYLINDRICAL ARTICLES

BACKGROUND OF THE INVENTION

This invention relates to the packing of cylindrical articles. More particularly, the invention relates to a method of, and equipment for, packing cylindrical articles.

The cylindrical article of the type in question is a lightweight cylindrical article which can stand, unassisted, on an end. The cylindrical article is of a lightweight material such as a plastics material. The invention has particular application in the packing of lightweight plastics bottles.

SUMMARY OF THE INVENTION

According to a first aspect of the invention, there is provided a method of packing cylindrical articles, the method including conveying articles to be packed to a receiving station; and displacing the articles from the receiving station to an accumulating station to form a predetermined, close packed array of the articles in the accumulating station, one of the accumulating station and the receiving station being displaceably arranged with respect to the other to facilitate arrangement of the articles in the accumulating station.

The method may include conveying the articles to the receiving station, via a conveying means, with a principal axis of each article extending in a predetermined direction relative to a conveying direction and turning each article through a predetermined angle such that the principal axis of each article adopts a second orientation relative to the conveying direction. In most cases the articles to be packed will be elongate and the principal axis of each article may thus be a longitudinal axis thereof.

Preferably, the method includes turning a plurality of the articles simultaneously at the receiving station and displacing said plurality of turned articles simultaneously into the accumulating station to form a row of the array in the accumulating station.

The method may include utilising a pusher arrangement arranged at the receiving station to displace the turned articles from the receiving station into the accumulating station and also to turn the articles prior to displacing the articles into the receiving station.

The accumulating station may comprise a framework having a pair of opposed side members. The distance between the opposed side members may vary in dependence on the type of array to be formed. Thus, for example, in respect of a hexagonal array, each row of articles in the array will be of a different length relative to an adjacent row.

Hence, to cater for this situation the method may include adjusting a length of the receiving station and, optionally, the length of the pusher arrangement.

The method may include adjusting the length of the receiving station by adjusting the relative positions of the accumulating station and the receiving station. In a preferred embodiment of the invention, the method may include displacing the accumulating station relative to the receiving station.

In the formation of each row, the method may include feeding a plurality of articles into register with the pusher arrangement. The method may include sensing when a sufficient number of articles is in position in front of the pusher arrangement prior to turning the articles.

The invention has particular application in the formation of a multi-layered pack of articles. Thus, the method may include, after the accumulating station has been filled, ejecting the array from the accumulating station into a first end of a delivery device. A packaging element may be mountable at an opposed, downstream end of the device. The length of the device may be such that more than one array of articles can be accommodated therein. Further, the method may include, as each array is urged through the delivery device, from an upstream end to a downstream end thereof, compressing the array peripherally such that the array is a tight fit within the packaging element.

According to a second aspect of the invention, there is provided equipment for packing cylindrical articles, the equipment including a receiving station for receiving articles to be packed;

a displacing means arranged in the receiving station in proximity to a conveying means for displacing articles from the conveying means; and an accumulating station mountable relative to the conveying means to receive articles displaced from the conveying means, one of the accumulating station and the receiving station being displaceably arranged with respect to the other to facilitate formation of a predetermined close packed array in the accumulating station.

The equipment may include a support arrangement on which the receiving station and the accumulating station are arranged.

The equipment may include an article turning means carried by the support arrangement at the receiving station for turning the articles prior to displacing the articles from the receiving station into the accumulating station.

The equipment may further include a pusher arrangement mountable to one side of the conveying means, in use, with the accumulating station being mountable on an opposed side of the conveying means, the pusher arrangement fulfilling the function both of the displacing means and the article turning means by controlling a length of stroke of the pusher arrangement.

Conveniently, the pusher arrangement may comprise a pusher element having a double stroke. Then, a first, short stroke extension of the pusher element may cause the articles to be turned whereafter the pusher element is retracted, but not fully, such as to block a further supply of articles to the receiving station. A second, longer stroke extension of the pusher element may cause displacement of the turned articles from the receiving station into the accumulating station.

The accumulating station may comprise a framework having a shape to form an array in which one row of articles has a different number of articles from an adjacent row.

To cater for the formation of an array where one row of the array differs in length from an adjacent row, a length of the receiving station may be adjustable. Optionally, the length of the pusher arrangement may also be adjustable.

In a preferred embodiment of the invention, the accumulating station is displaceably arranged relative to the receiving station, displacement of the accumulating station controlling the length of the receiving station.

In this regard, the receiving station may be defined by an end plate arranged at a downstream end of the receiving station with an upstream end of the receiving station being defined by an upstream end of the pusher element. For the sake of convenience, the upstream end of the pusher element is referred to as the "first" end of the pusher element.

The spacing between the first end of the pusher element and the end plate may, accordingly, be adjustable.

Then, the equipment may include an adjustment means, part of which is arranged on the accumulating station and part of which is arranged at the receiving station for effecting adjustment of the length of the receiving station by displacement of the accumulating station relative to the receiving station.

The equipment may include a delivery device into which a packed array from the accumulating station is received for packing in a packaging element. The delivery device may be mountable beneath the conveying means with the accumulating station being displaceable into alignment with the delivery device to facilitate transferral of the packed array from the accumulating station into the delivery device.

The delivery device may be in the form of a tube. The tube may have a transverse cross-sectional shape similar to that of the shape of the framework of the accumulating station. In other words, if the framework of the accumulating station is polygonal in outline, the delivery tube may be of corresponding polygonal transverse, cross-section.

Preferably, the delivery device includes two identical tubes arranged side-by-side beneath the conveying means. The tubes may be reciprocally displaceable beneath the conveying means to improve the efficiency of the packing operation.

The equipment may include an ejecting means for ejecting the packed array from the accumulating station into the delivery device. The ejecting means may comprise an ejector plate arranged upstream of an inlet end of one of the tubes of the delivery device. Then, in use, the accumulating station, once filled with articles, may be received between the ejecting means and the relevant tube. The ejecting means may then be operated to eject the array of articles from the accumulating station into the delivery device.

Each tube of the delivery device may be stepped along its length so that an outlet end of the delivery device is of smaller cross-section than an inlet end.

With this arrangement, the array discharged through the outlet end of the tube is compressed peripherally such that it is a tight fit within a packaging element arranged at said outlet end of the delivery device. It will be appreciated that this is of importance where the packaging element is a flexible packaging element such as a sleeve of a synthetic plastics material.

For this purpose also, the equipment may include a delivery table arranged at an outlet end of the delivery device.

Finally, the equipment may include a detecting means for detecting when there is a sufficient number of articles in the receiving station. The detecting means may be arranged at an upstream end of the receiving station, upstream of the first end of the pusher element.

The invention extends also to a component for packing equipment, the component comprising a framework into which articles are receivable, the framework defining a required shape of array of packed articles.

The invention is now described by way of example with reference to the accompanying diagrammatic drawings.

DETAILED DESCRIPTION OF DRAWINGS

Figure 1:
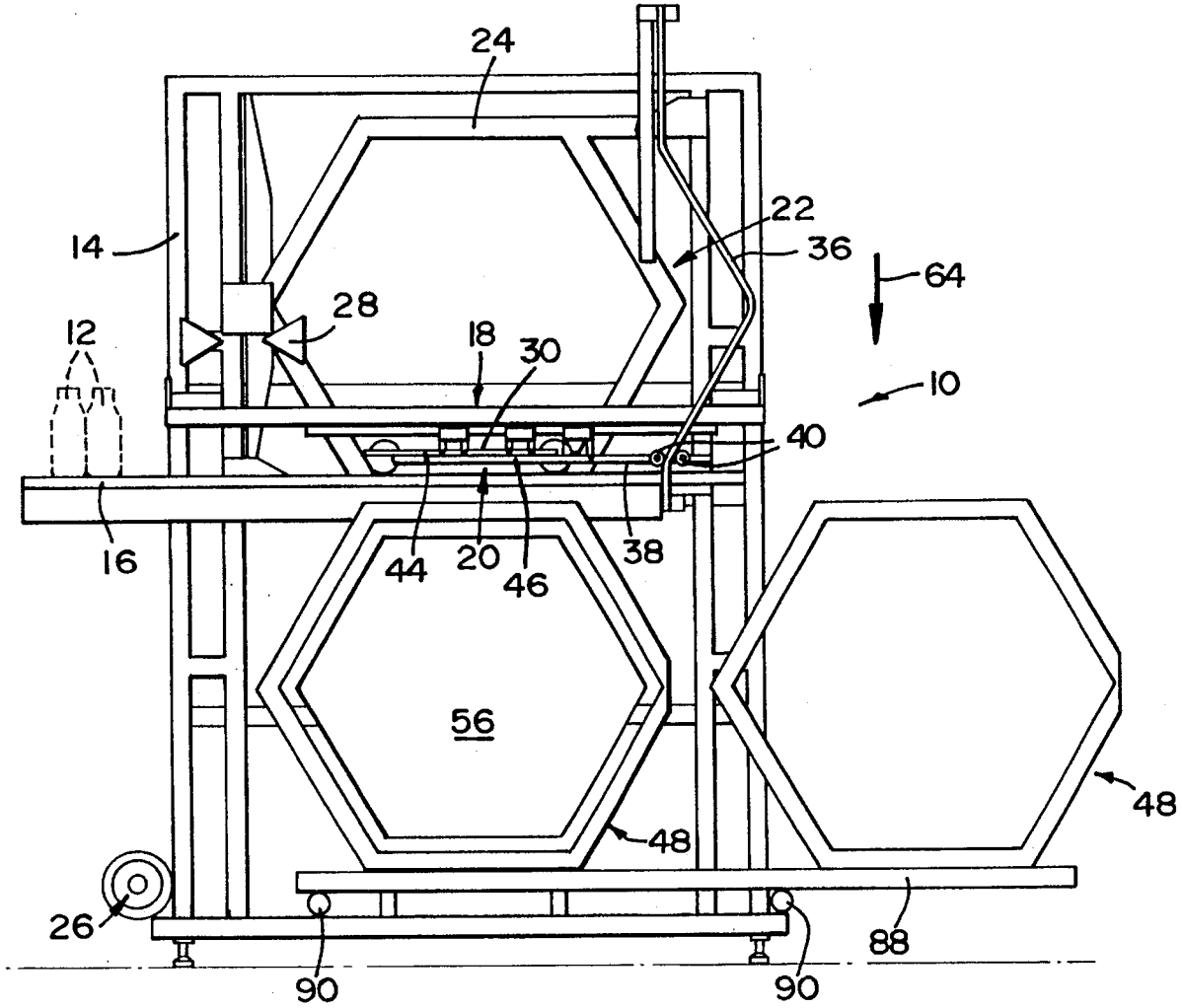
FIG. 1 shows a front view of equipment, in accordance with the invention, for packing cylindrical articles.

Referring to the drawings, equipment, in accordance with the invention, for packing cylindrical articles is illustrated and is designated generally by the reference numeral 10. The equipment 10 is intended particularly for use in the packing of lightweight plastics bottles 12 (FIG. 1) and will be described with reference to this application hereafter.

The equipment 10 comprises a support arrangement in the form of a support frame 14. The support frame 14 is, in use, mounted proximate a downstream end of a conveyor means or conveyor 16.

A receiving station 18 is carried on the frame 14 above the conveyor 16. Bottles 12 to be packed are received in the receiving station 18 as will be described in greater detail below.

A pusher arrangement 20 which fulfils the function both of a bottle turning means as well as a bottle displacing means is arranged at the receiving station 18, on one side of the conveyor 16.

An accumulating station 22 is carried by the support frame 14 adjacent the receiving station 18 on an opposed side of the conveyor 16.

The accumulating station 22 comprises a framework 24 having a shape corresponding to an array of the bottles 12 to be formed. As illustrated, the frame work 24 is hexagonal to form a hexagonal array of bottles 12. It will be appreciated that, by changing the shape of the framework 24 of the accumulating station 22, the shape of the array of bottles 12 to formed can, correspondingly, be changed. The accumulating station 22 is displaceably carried on the frame 14 from a first position, as shown in the drawings, to a second, delivery position in which bottles packed within the framework 24 can be ejected from the framework 24, as will be described in greater detail below. Hence, the equipment 10 includes a drive motor 26 (FIG. 1) for facilitating vertical displacement of the accumulating station 22 on the frame 14. Still further, the equipment 10 includes a sensing device 28 (such as a microswitch) for sensing the vertical position of the accumulating station 22 on the frame 14.

The pusher arrangement 20 comprises a pusher element 30 which is acted on by a pneumatic piston/cylinder assembly (not shown). The pusher element 30 has a double stroke. A first stroke causes the bottles 12 to be turned through 90°. In this regard, it will be appreciated that the bottles are transported along the conveyor 16 with their longitudinal axes extending vertically. To pack the bottles 12 into the framework 24 of the accumulating station 22 the bottles 12 must be turned through 90° such that their longitudinal axes lie horizontally but at right angles to the direction of feed of the bottles 12. Thus, a first, shorter stroke of the pusher element 30 causes the bottles to be turned. To facilitate turning of the bottles, a rail 32 (FIG. 2) is carried on the equipment 10 above and to one side of the conveyor 16, the rail 32 extending in the direction of feed of the bottles 12 and being arranged above a centre of gravity of the bottles 12. As the pusher element 30 is extended, on the first stroke, the bottles 12 within the receiving station 18 are urged against the rail 32 and are turned. The pusher element 30 is then retracted, but not fully, such that it is in the position shown in FIG. 3 of the drawings to inhibit a further supply of bottles 12 in front of the pusher element 30.

A second, longer extension of the pusher element 30 causes the turned bottles 12 lying in front of the pusher element to be urged into the accumulating station 22.

In the case of an array to be formed where adjacent rows differ in length (as is the case in respect of the hexagonal array formed with the illustrated accumulating station 22), it is necessary for the receiving station 18 to be adjusted in length to receive the desired number of bottles 12 therein to form a row of the array.

For this purpose, the equipment 10 includes an adjustment means 34. The adjustment means 34 comprises a cam-like element or cam rail 36 carried by the accumulating station 22. It will be appreciated that, as the accumulating station 22 moves on the frame 14, so does the cam-like element 36.

An extension 38 of the receiving station 18 carries a follower 40 thereon. The follower 40 bears against the cam-like element 36 and, as the cam-like element 36 is displaced relative to the follower 40, the length of the receiving station 18 is adjusted.

The length of the receiving station 18 is defined by an end plate 42 (omitted from FIG. 1 for the sake of clarity) and an upstream or first end 30.1 (FIG. 3) of the pusher element 30. Reference to adjusting the length of the receiving station thus refers to adjusting the distance between the end plate 42 and the first end 30.1 of the pusher element 30.

Figure 2:
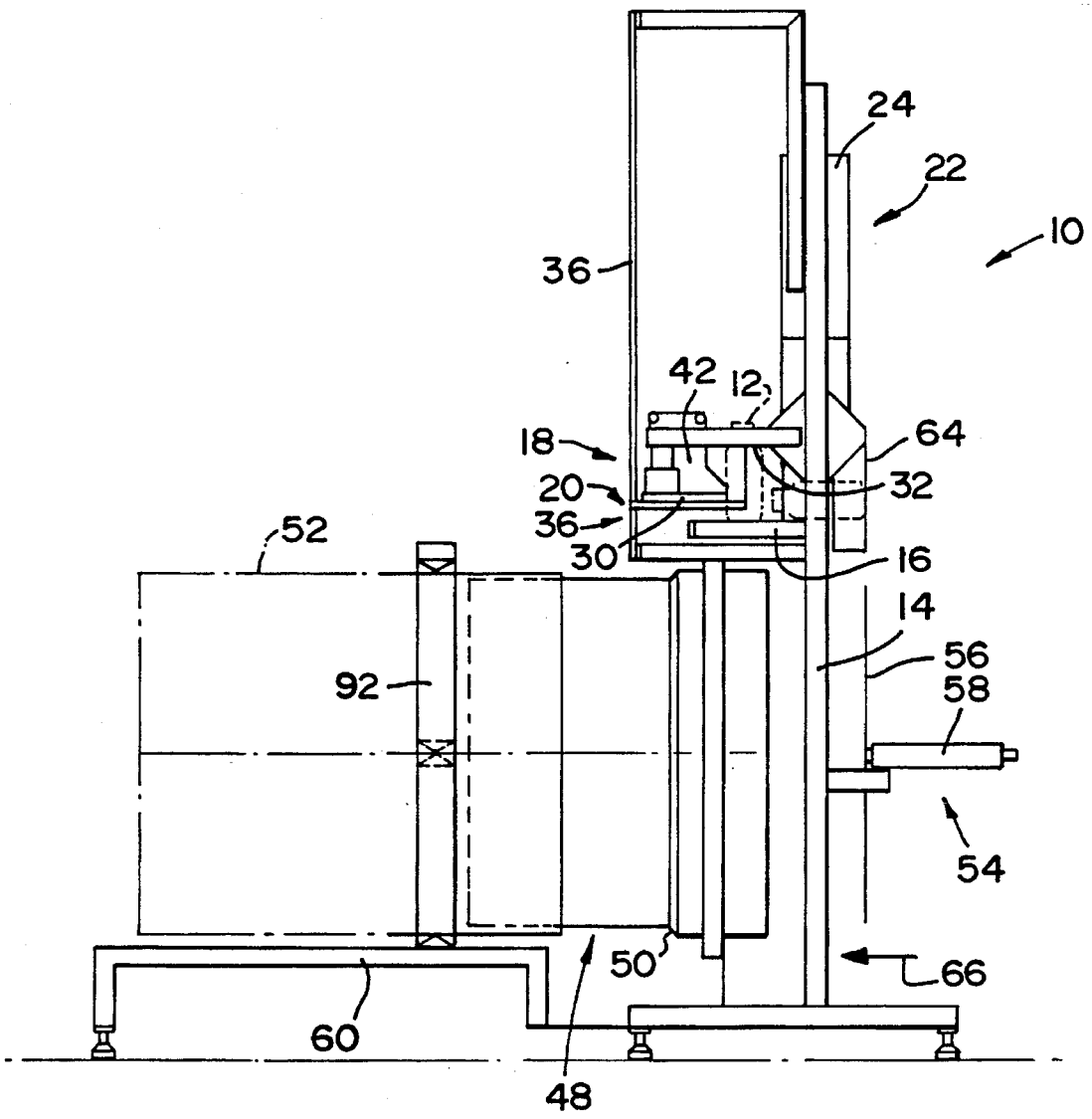
FIG. 2 shows a side view of the equipment.
Figure 3:
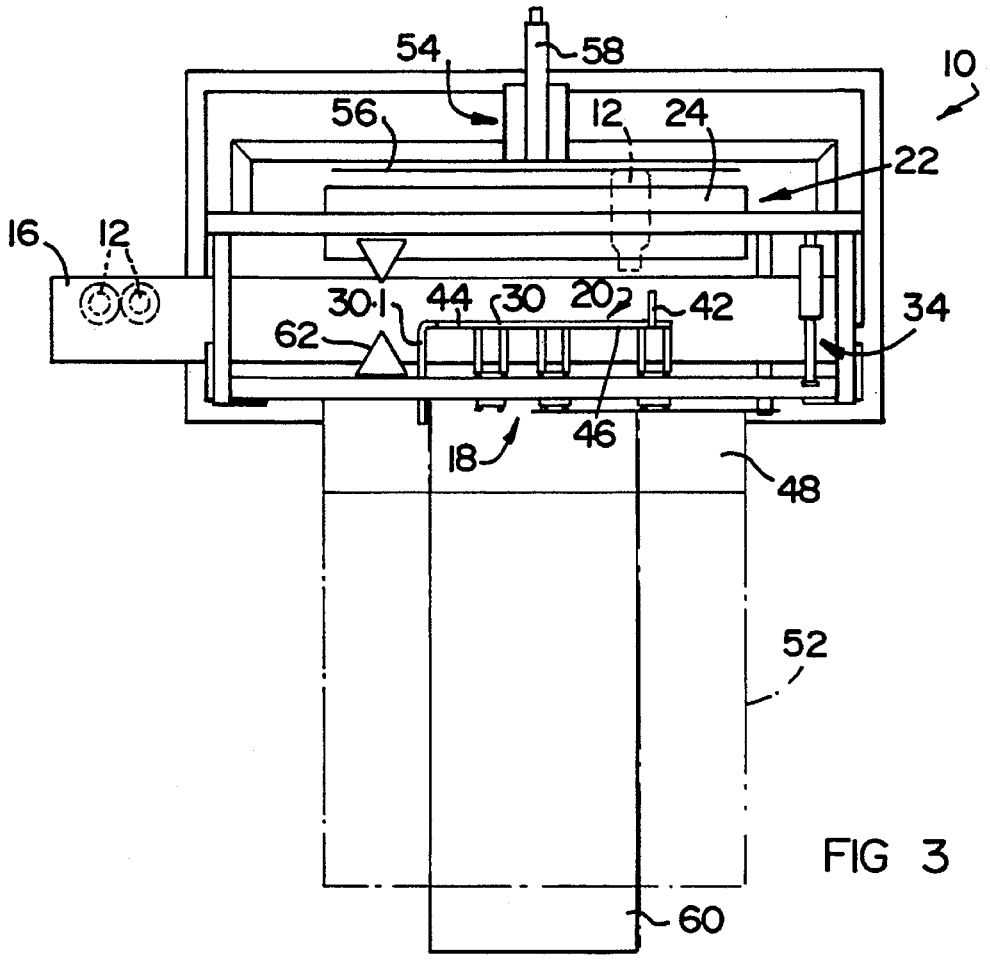
FIG. 3 shows a plan view of the equipment.

In the embodiment shown in FIGS. 1 to 3, the pusher element 30 comprises two discrete parts 44 and 46 which are displaceable relative to each other in a direction parallel to the direction of feed of the bottles 12. A cable and pulley arrangement (not shown) is carried by the parts 44 and 46 to effect movement of the parts 44 and 46 relative to each other. Movement of the cam-like element 36 relative to the follower 40 causes displacement of the part 46 which in turn, via the cable and pulley arrangement, causes displacement of the part 44 relative to the part 46.

Figure 4:
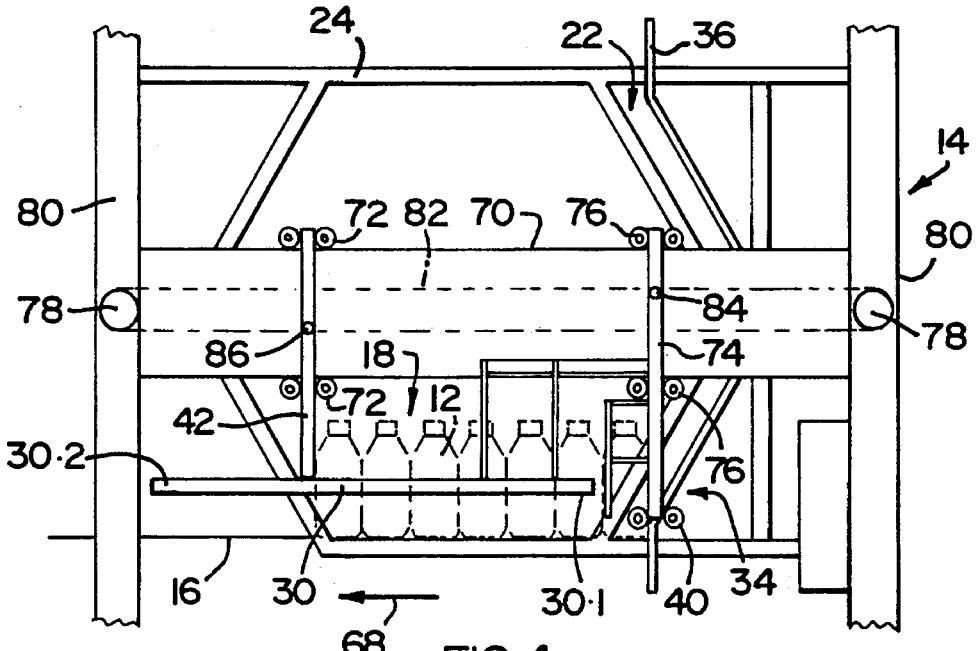
FIG. 4 shows a side view of an adjustment means of the equipment.

Referring now to FIG. 4 of the drawings, a development of the adjustment means 34 is shown.

In this embodiment of the invention, it is firstly to be noted that the direction of feed of the bottles 12 into the receiving station 18 is in the direction of arrow 68.

Also, the pusher element 30 is of a one-piece construction rather than comprising two separate parts 44 and 46, as described above. A downstream end 30.2 of the pusher element 30 projects beyond the end plate 42 of the receiving station 18.

The support frame 14 includes a horizontally extending member 70. The support plate 42 is displaceably supported on the member 42 via rollers 72. Also, the follower 40 is carried on a vertically extending member 74 which, once again, is displaceably carried on the member 70 via rollers 76.

The adjustment means 34 comprises a pair of pulleys 78 carried on spaced, vertically extending members 80 of the support frame 14. An endless cable 82 extends over the pulleys 78. The cable 82 is secured to the member 76 at 84 and to the end plate 42 at 86. Hence, it will be appreciated that, as the accumulating station 24 moves vertically, the follower 40 bears against the cam-like element or cam rail 36 to cause horizontal displacement of the member 76 and hence the position of the first end 30.1 of the pusher element 30. Also, due to the connection of the end plate 42 to the member 74 via the cable 82, the end plate 42 moves in a horizontal direction opposite to that of the direction of movement of the member 74. Further, it will be appreciated that the effective length of the pusher element 30 is varied by the amount by which the end 30.2 of the pusher element 30 projects beyond the end plate 42.

The equipment 10 is intended particularly for use in the formation of a multi-layered pack. For this purpose, a delivery device in the form of a pair of delivery tubes 48 is arranged on the frame 14 beneath the receiving station 18. When the accumulating station 22 is in its second, delivery position it is in alignment with an inlet end of one of the delivery tubes 48. The two tubes are arranged side-by-side on a reciprocating shuttle frame 88. The frame 88 is displaceably supported on the support frame 14 via rollers 90. It will be appreciated that, with this configuration, the efficiency of the packing operation is improved. It is to be noted that the second tube 48 is omitted from FIGS. 2 and 3 for the sake of clarity.

Each delivery tube 48 has a transverse cross-sectional profile corresponding to that of the framework 24 of the accumulating station 22. In other words, in the case of the hexagonal framework 24, the delivery tube will have a corresponding hexagonal transverse cross-section. It is important that, when the bottles 12 are packed in a flexible pack such as a sleeve 52, each array of the multi-layered pack is a tight fit within the sleeve 52. This ensures that the bottles 12 maintain their orientation in the sleeve 52. If the bottles 12 can maintain their orientation, the need for expensive unscrambling machines may be obviated. Thus, to ensure that each array of the multi-layered pack is a tight fit within the sleeve 52, each delivery tube 48 is stepped along its length, as illustrated at 50 in FIG. 2 of the drawings. This compresses each array peripherally as it is urged through the delivery tube 48 from the inlet end to an outlet end of the delivery tube 48.

An ejecting means in the form of an ejector plate assembly 54 is carried on the frame 14. The ejector plate assembly 54 comprises an ejector plate 56 which is acted on by a fluid operated piston/cylinder assembly 58. As best seen in FIG. 2 of the drawings, the ejector plate assembly 54 is arranged outwardly of the accumulating station 22 (when in its second position) such that, when the accumulating station 22 moves downwardly on the frame 14 to its second position, it is received between the ejector plate 56 and the inlet end of that delivery tube 48 aligned with the ejector plate 56.

A delivery table 60 is arranged at the outlet end of the delivery tube 48 aligned with the ejector plate 56. The sleeve 52 is received on the table 60, in use.

Finally, a sensing means in the form of a bottle detector 62 is arranged above the conveyor 16 upstream of the first end 30.1 of the pusher arrangement 30 to detect the presence of a bottle upstream of said end 30.1. It will be appreciated that, when such a bottle is detected for longer than a predetermined period of time, this will serve as a signal to a control circuit (not shown) of the equipment 10 to execute a turning and displacing operation as will be described hereafter.

In use, bottles 12 to be packed in the accumulating station 22 are fed via the conveyor 16 to the receiving station 18. The first bottle 12 abuts against the end plate 42 and the bottles 12 then build up in front of the pusher element 30 to form a row of bottles 12. When a bottle 12 is detected by the bottle detector 62 for the required period of time, a signal is sent by the control circuitry to the fluid operable piston/cylinder assembly which acts on the pusher element 30. This causes the pusher element 30 to be extended over the conveyor 16.

The first extension of the pusher element 30 causes the row of bottles 12 in front of the pusher element 30 to be turned through 90° such that they lie horizontally. After the turning operation, the pusher element 30 is retracted to the position shown in FIG. 3 of the drawings. The pusher element 30 is again extended towards the opposed side of the conveyor 16 thereby urging the first row of bottles 12 into the framework 24 of the accumulating station 22. On the second extension, the pusher element 30 executes a longer stroke than on the first extension to urge the row of bottles into the framework 24. Once this has been effected, a signal is sent by control circuitry of the equipment to the drive motor 26 causing the accumulating station 22 to move downwardly in the direction of arrow 64 (FIG. 1). Movement of the accumulating station 22 downwardly causes the cam-like element 36 to act on the follower 40 thereby increasing the length of the receiving station 18.

Thereafter, the pusher element 30 is fully retracted to a position outwardly of the conveyor 16 such that a further supply of bottles is received in front of the pusher element 30. Once again, once a bottle 12 has been detected by the bottle detector 62 for the required period of time, the pusher element 30 again carries out the turning and displacing operation to form a second row of bottles 12 in the framework 24 of the accumulating station 22.

The bottle feeding, turning, displacing and framework lowering operations are repeated until the framework 24 has been filled with bottles. To ensure that the bottles 12 are accurately positioned in the framework 24 of the accumulating station 22, a stop plate 63 (FIG. 2) is arranged on the frame 14 behind the framework 24 of the accumulating station 22.

Once the framework 24 of the accumulating station 22 has been filled, the accumulating station 22 is driven into its second, delivery position in alignment with the inlet end of one of the delivery tubes 48 by the drive motor 26.

The ejector plate assembly 54 is then activated to cause displacement of the ejector plate 56 in the direction of arrow 66 (FIG. 2).

Displacement of the ejector plate 56 ejects the bottles from the framework 24 of the accumulating station 22 into the delivery tube 48. If this is the first array received in the delivery tube, the bottles remain within the delivery tube 48.

The accumulating station 22, once emptied of its bottles, is again raised to the position shown in the drawings. The filling of the accumulating station is then repeated whereafter the accumulating station 22 is again lowered and the packed bottles are ejected from the accumulating station 22 into the delivery tube 48. Once a sufficient number of layers or arrays are contained within the delivery tube 48 to fill the tube 48, the supply of a further array will cause the first array to be ejected from the outlet end of the tube 48 into the sleeve 52. This process will be repeated until the sleeve 52 contains the desired number of arrays or layers.

As indicated above, the compression of each array as it is urged through the tube 48 causes each array to be a tight fit within the sleeve 52 thereby facilitating the maintenance of the integrity of each array.

Once the sleeve 52 contains the required number of arrays, the inlet end of the sleeve 52 is sealed by a sealing unit 92 (FIG. 2) carried on the table 60. The sealing unit 92 is omitted from FIGS. 1 and 3 for the sake of clarity.

It is a particular advantage of the invention that packing equipment is provided which will obviate the need for manual labour other than the mounting of the sleeve 52 on the delivery tube 48. Also, with the configuration of the delivery tube 48, the packs formed will have less likelihood of losing their integrity so that, as indicated above, the bottles in the pack maintain their orientation. Further, the packing equipment 10 lends itself to the packing of bottles in sleeves as opposed to cartons thereby reducing packing costs.

We claim:

1. A method of packing cylindrical articles, the method including conveying articles to be packed to a receiving station;

displacing the articles from the receiving station to an accumulating station to form a predetermined, close packed array of the articles in the accumulating station, one of the accumulating station and receiving station being displaceably arranged with respect to the other to facilitate arrangement of the articles in the accumulating station; and adjusting a length of the receiving station by adjusting the relative positions of the accumulating station and the receiving station to cater for the situation where adjacent rows of the array differ in length.

2. The method as claimed in claim 1 which includes conveying the articles to the receiving station with a principal axis of each article extending in a predetermined direction relative to a conveying direction and turning each article through a predetermined angle such that the principal axis of each article adopts a second orientation relative to the conveying direction.

3. The method as claimed in claim 2 which includes turning a plurality of the articles simultaneously at the receiving station and displacing said plurality of turned articles simultaneously into the accumulating station to form a row of the array in the accumulating station.

4. The method as claimed in claim 3 which includes utilising a pusher arrangement arranged at the receiving station to displace the turned articles from the receiving station into the accumulating station.

5. The method as claimed in claim 1 which includes displacing the accumulating station relative to the receiving station.

6. The method as claimed in claim 1 which includes, after the accumulating station has been filled, ejecting the array from the accumulating station.

7. Equipment for packing cylindrical articles, the equipment including a receiving station for receiving articles to be packed;

a displacing means arranged in the receiving station in proximity to a conveying means for displacing articles from the conveying means;

an accumulating station mountable relative to the conveying means to receive articles displaced from the conveying means, one of the accumulating station and the receiving station being displaceably arranged with respect to the other to facilitate formation of a predetermined close packed array in the accumulating station, and a length of the receiving station being adjusted by adjusting the relative positions of the accumulating station and the receiving station to cater for the situation where adjacent rows of the array differ in length.

8. The equipment as claimed in claim 7 which includes a support arrangement on which the receiving station and the accumulating station are arranged.

9. The equipment as claimed in claim 8 which includes an article turning means carried by the support arrangement at the receiving station for turning the articles prior to displacing the articles from the receiving station into the accumulating station.

10. The equipment as claimed in claim 9 which includes a pusher arrangement mountable to one side of the conveying means, in use, with the accumulating station being mountable on an opposed side of the conveying means, the pusher arrangement fulfilling the function both of the displacing means and the article turning means by controlling a length of stroke of the pusher arrangement.

11. The equipment as claimed in claim 10 which includes a delivery device into which a packed array from the accumulating station is received for packing in a packaging element.

12. The equipment as claimed in claim 11 in which the accumulating station is displaceably arranged relative to the receiving station, displacement of the accumulating station controlling the length of the receiving station.

13. The equipment as claimed in claim 11 which includes an adjustment means, part of which is arranged on the accumulating station and part of which is arranged at the receiving station for effecting adjustment of the length of the receiving station by displacement of the accumulating station relative to the receiving station.

14. The equipment as claimed in claim 11 in which the delivery device is mountable beneath the conveying means with the accumulating station being displaceable into alignment with the delivery device to facilitate transferral of the packed array from the accumulating station into the delivery device.

15. The equipment as claimed in claim 14 which includes an ejecting means for ejecting the packed array from the accumulating station into the delivery device.

16. The equipment as claimed in claim 11 in which the delivery device is stepped along its length so that an outlet end of the delivery device is of smaller cross-section than an inlet end.

17. The equipment as claimed in claim 7 which includes a detecting means for detecting when there is a sufficient number of articles in the receiving station.

* * * * *